United States Patent [19]

Caron et al.

[11] 4,066,375

[45] Jan. 3, 1978

[54] REPLACEMENT CAP FOR COMPACTOR WHEEL

[75] Inventors: James O. Caron, Modesto; Fred J. Caron, Lodi; Norman F. Cady, El Cajon, all of Calif.

[73] Assignee: Caron Compactor Company, Stockton, Calif.

[21] Appl. No.: 770,709

[22] Filed: Feb. 22, 1977

[51] Int. Cl.[2] ..... E01C 19/26

[52] U.S. Cl. ..... 404/121; 172/554; 301/44 R

[58] Field of Search ..... 404/121, 124; 172/540, 172/554; 301/43, 44 R, 44 B

[56] References Cited

U.S. PATENT DOCUMENTS

| | | | |
|---|---|---|---|
| 3,650,185 | 3/1972 | Takata | 404/121 |
| 3,656,418 | 4/1972 | Lutz | 404/121 |
| 3,822,957 | 7/1974 | Caron | 404/121 |
| 3,922,106 | 11/1975 | Caron | 404/121 |

*Primary Examiner*—Nile C. Byers

*Attorney, Agent, or Firm*—Flehr, Hohbach, Test, Albritton & Herbert

[57] ABSTRACT

A replacement cap for use on the tip of a compaction wheel foot. The cap includes a pair of half-caps weldable together on the end of the tip. The half-caps are generally rectangular and are formed with inner end portions having facets which abut to form V-shaped weld pockets. The half-caps are shaped so as to snugly fit on tips having varied wear patterns. Replacement time, weld material and replacement costs are thereby reduced.

10 Claims, 6 Drawing Figures

FIG. 6
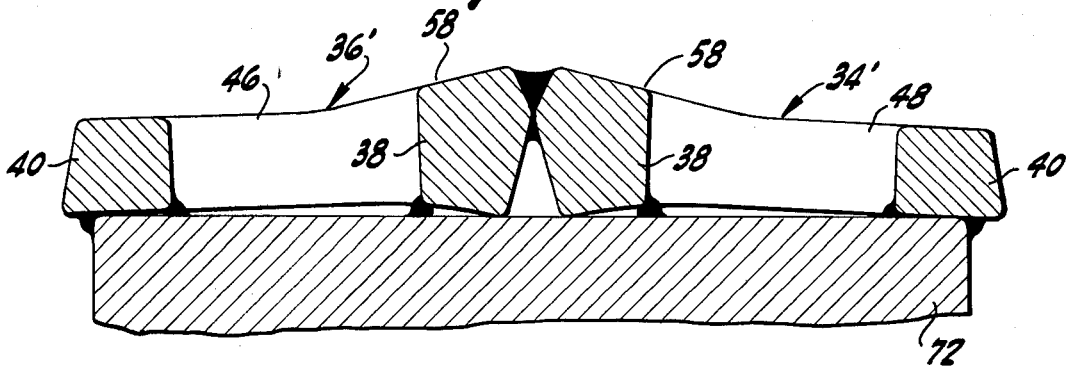
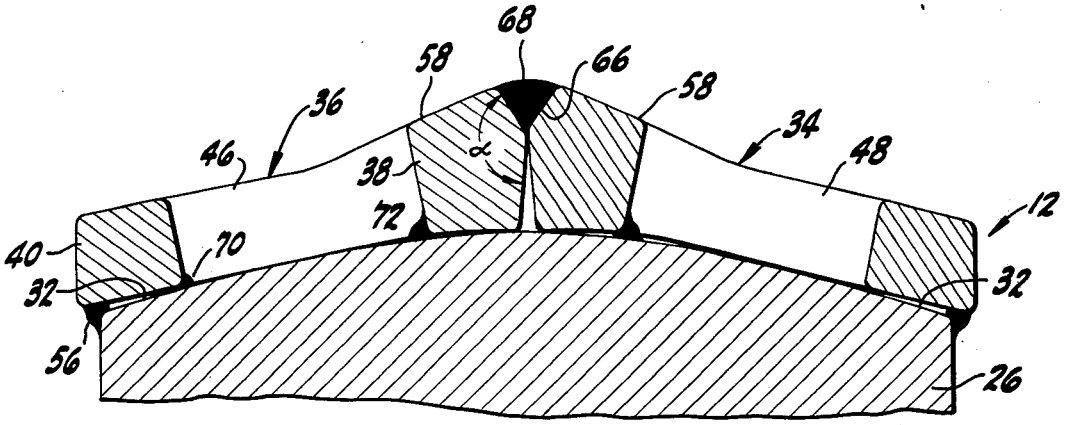
FIG. 5

REPLACEMENT CAP FOR COMPACTOR WHEEL

BACKGROUND OF THE INVENTION

This invention relates in general to earth and refuse compaction equipment, and in particular relates to replacement caps for use on the tips of compactor wheels for such equipment.

Replacement caps for compaction wheels have previously been provided. Prior replacement caps include single-piece rectangular members which are welded onto the worn tips of compactor wheel feet. The shape and size of these caps is generally commensurate with the rectangular shape of the tips. The caps have a generally triangular-shaped side profile with a bottom edge curved about a radius commensurate with the curved surface of a typical worn cap. However, such a replacement cap forms a good fit only with tips which are worn to a similar profile; they do not fit properly and leave gaps with the tip ends which may be irregularly worn. With the irregularly worn tips it is therefore necessary to fill the gaps with weld material, which is expensive and time-consuming. It would be desirable to provide a replacement cap design which will universally fit tips worn to different shapes, and which can be replaced with a minimum of time, weld material and expense.

OBJECTS AND SUMMARY OF THE INVENTION

It is the general object of the invention to provide a new and improved replacement cap for use on the wheel foot tips of compaction equipment.

Another object is to provide a replacement cap of the character described which can be snugly fitted and welded onto compaction wheel tips having varied wear patterns.

Another object is to provide a replacement cap of the character described which is faster to weld on a compaction wheel tip and which minimizes the cost of labor and material for replacing the caps.

Another object is to provide an article of manufacture comprising a half-cap specially shaped for joining with an identical half-cap to form a complete replacement cap for a compactor wheel foot.

The invention in summary includes a replacement cap and article of manufacture comprised of half-caps which are formed in a generally rectangular annular shape. The half-caps have a configuration which permits them to be snugly fit onto the ends of wheel foot tips with varied wear patterns. Inner end portions of each half-cap are shaped with outwardly converging facets so that when the half-caps abut one another on the wheel tips V-shaped weld pockets are formed to receive the weld material. The outer end portions of the half-caps are sized to project over the edges of the tips so as to protect the underlying weld bead. Central apertures in each half-cap are adapted to become filled with earth or refuse material during operation and function to extend the life of the replacement cap.

The foregoing and additional objects and features of the invention will appear from the following description in which the several embodiments of the invention have been set forth in connection with the accompanying drawings.

BRIEF DESCRIPTION OF THE DRAWINGS

FIG. 5 is a longitudinal sectional view of a replacement cap shown in FIG. 1.

FIG. 6 is a longitudinal sectional view of a replacement cap shown in use as an adaptor when welded to the flat end of a wheel foot tip.

DESCRIPTION OF THE PREFERRED EMBODIMENTS

Figure 1:
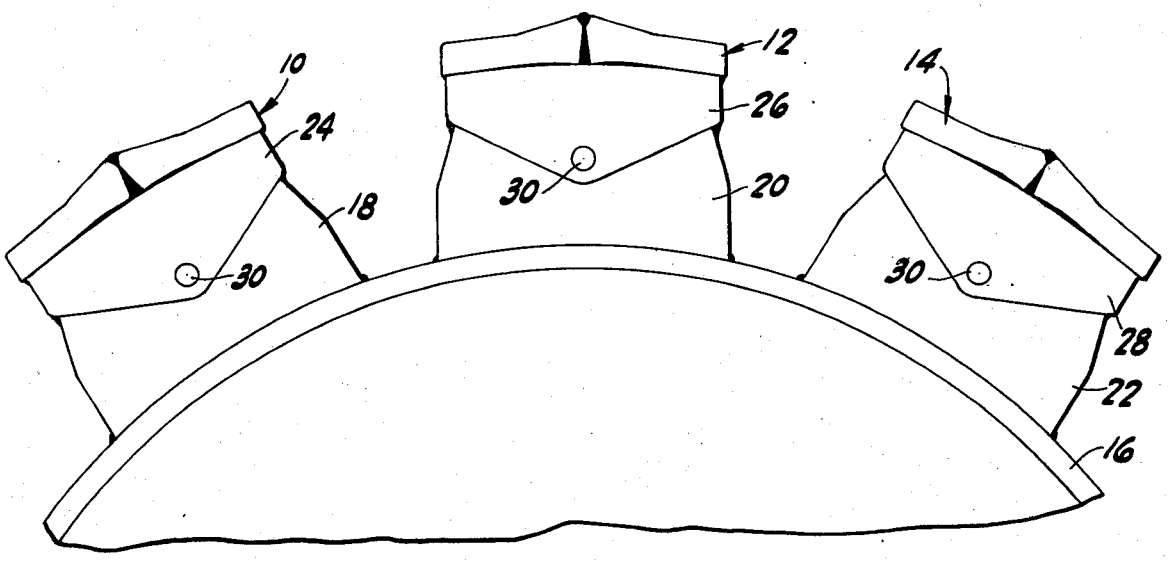
FIG. 1 is a side elevational view of a portion of an earth compaction wheel showing replacement caps of the invention welded on worn tips of the wheel feet.

In the drawings FIG. 1 illustrates generally at 10, 12 and 14 replacement caps of the invention shown mounted on the wheel 16 of an earth and refuse compactor vehicle. The wheel 16 includes a plurality of laterally outwardly projecting compactor feet 18, 20, 22, three of which are illustrated, mounted about the periphery of the wheel rim. The outer ends of the compactor feet carry wear tips 24, 26, 28 which are secured in place by means of mounting pins 30 and by welding.

The replacement caps of the invention are specially adapted for use on compactor wheel tips which are worn after prolonged use. Typically the tips are worn with a generally rounded (both laterally and longitudinally) outwardly convex surface pattern 32 as illustrated in FIG. 5 for the tip 36. The compactor tips could be worn down to the uniform wear pattern as illustrated in the figure, or they could also be worn to an irregular or non-uniform pattern.

The construction and mounting of replacement cap 12 is typical and is illustrated in FIGS. 2–5. Cap 12 includes a pair of identically-shaped half-caps 34,36 which are adapted to abut together and be welded onto the outer end of tip 26.

Figure 3:
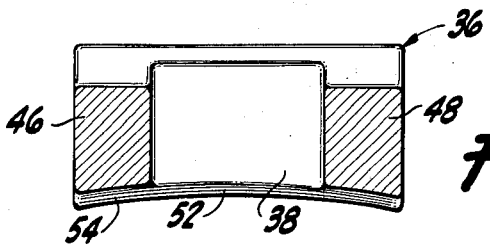
FIG. 3 is a cross-sectional view taken along line 3—3 of FIG. 2.
Figure 2:
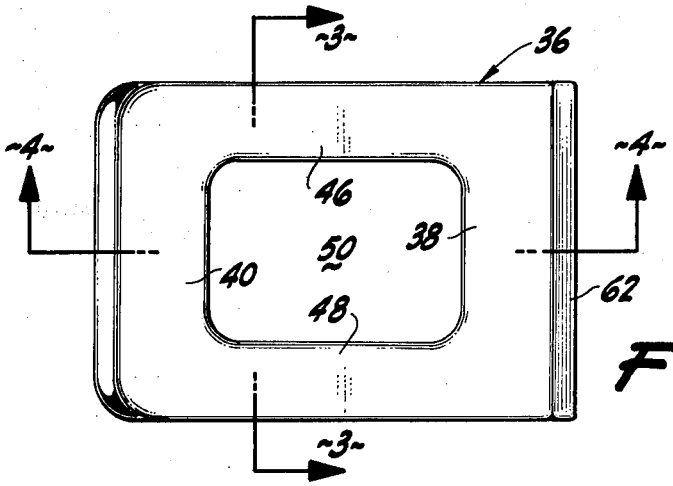
FIG. 2 is a top plan view of a half-cap which comprises a part of one of the replacement caps of FIG. 1.
Figure 4:
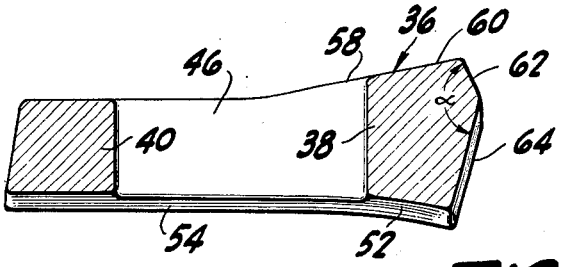
FIG. 4 is a longitudinal sectional view taken along the lines 4—4 of FIG. 2.

Half-cap 36 comprises a body formed of a suitable abrasion resistant cast steel. The body is an annulus having a generally rectangular shape and includes inner end portion 38 and outer end portion 40 integral with side portions 46,48 which enclose a central aperture 50. As best illustrated in FIGS. 3 and 4 the bottom surfaces 52,54 of the end and side portions are rounded concave to be generally commensurate with the lateral and longitudinal outwardly convex rounded profile of the compactor tip end. This provides a generally snug fit with the tip so that there is a minimum gap or clearance space above tip surface 32. Each half-cap is sized in plan view with an outer periphery larger than the periphery of the underlying half-portion of the tip. Preferably the half-caps are sized so that outer end portion 40 projects beyond the tip edge approximately ¼th inch. The resulting overhang portion serves to protect the weld bead 56 which is made between the tip and end portion when the half-cap is welded in place.

The inner end portion 38 of each half-cap is formed with a vertical height of substantially 50% greater than the vertical height of the outer end portion, with the upper surfaces 58 of the side portions inclining upwardly to merge with the upper surface 60 of the end portion. When the half-caps are mounted together on the tip the enlarged inner end portions combine to form the outwardly directed point or wedge profile shown in FIG. 5. The resulting replacement cap thereby has installed dimensions generally equivalent to that of a new compaction wheel tip.

Inner end portion 38 of each half-cap is also formed with upper and lower generally flat facets 62, 64 lying in laterally extending converging planes which form the outwardly directed wedge shown in FIG. 4. The apex of the wedge is positioned above the horizontal midline of the half-cap body so that the upper facet is of shorter length. The planes of the facets converge at an included angle $\beta$ which preferably is in the range of 145° to 150°. Thus when two of the half-caps inner ends abut one another on a tip the upper facets diverge apart at an upward angle of 30° or more. The upper facets thereby form a V-shaped weld pocket or channel 66 in which a bead 68 of weld material can be laid. The configuration of the facets is such that a sufficient weld pocket is maintained where the replacement cap is mounted on tips having a range of irregular wear patterns.

The use and operation of the invention is as follows. The pair of half-caps 34,36 are mounted together with the inner end portions 38 abutting over the midline of the tamper foot tip in the manner illustrated in FIG. 5. The lower concave surfaces 52, 54 of the half-caps will conform to the rounded profile of the tip. The two half-caps can be adjusted in position as required to conform to tips of either regular or irregular wear patterns. When in the desired position the half-caps are welded in position by laying the weld beads 56 between the tip and lower surface of the outer end portion and the bead 68 along V-shaped pocket 66. Additional beads 70, 72, as required, can be laid along the lower corners of the apertures in the half-caps.

A pair of half-caps 36 and 34 can be welded in the manner described above to a tamper foot 72 having a flat end as illustrated in FIG. 6. In such case the half-caps could be utilized as adaptors to which additional half-caps can be welded to form a replacement cap.

The replacement cap of the invention greatly simplifies the repair of worn tips on tamper feet. The novel configuration of the half-caps permits a snug fit on tips worn to either regular or irregular patterns. Gap spacing between the half-caps and tip is minimized so that the requirement for weld material to fill the gaps is minimized. At the same time, the V-shaped weld pocket between the tips is maintained for welding the half-caps together. The welding operation can be performed with the half-caps in flat position so that welding time is reduced. The costs of labor and material in welding the replacement caps is substantially less than that required for installing a one-piece replacement cap. The recessed volume formed by the apertures in the half-cap is adapted to fill and compact with material to thereby increase the wear life of the cap.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A replacement cap for use on the tip of a compaction wheel foot, said cap including a pair of half-caps, each half-cap comprising a body of generally rectangular shape having an outer end portion integral with an inner end portion, said inner end portion of each half-cap including upper and lower generally flat facets lying in planes extending transverse of the cap and which converge outwardly to form a wedge having an apex, and weld means for securing the half-caps to the tip and to each other with said apexes of the half-caps abutting one another intermediate the tip whereby adjacent upper facets on the half-caps diverge apart to form a V-shaped pocket for placement of weld material.

2. A replacement cap as in claim 1 which includes means forming a recessed volume centrally of each half-cap for collection and compaction of loose material such as earth or refuse.

3. A replacement cap as in claim 1 in which said facets on each half-cap converge at included angles in a range of 145° to 150° whereby when the half-caps are mounted on a tip having an end which is outwardly convex the adjacent upper facets diverge apart at an angle of 30° or more.

4. A replacement cap as in claim 1 in which the lower surfaces of each half-cap are formed with concave surfaces generally commensurate in contour with the outwardly convex surface contours of the tip ends for interfitting therewith.

5. A replacement cap as in claim 1 in which the outer end portions are sized to project over the underlying tip edge for protecting weld material lying along and between such edge and outer end portion.

6. A replacement cap as in claim 1 in which the inner end portions of each half-cap are formed with vertical heights substantially 50% greater than the vertical heights of the respective outer end portions whereby the half-caps when secured together on a tip combine to form an outwardly pointed wedge.

7. An article of manufacture for use on the tip of a compaction wheel foot, said article comprising a body formed of an abrasion resistant material, said body having outer and inner spaced-apart end portions joined integral with a pair of laterally spaced-apart side portions, said side and end portions forming a generally rectangular annulus having a width and length generally commensurate with the respective width and length of a half end portion of the tip whereby a pair of said bodies when welded on respective half end portions of the tip form a cap over the tip.

8. An article of manufacture as in claim 7 in which said inner end portion is formed with upper and lower facets extending in lateral planes which converge outwardly of the body to a pointed apex whereby when a pair of the bodies are mounted on a tip the respective apexes abut one another with adjacent upper facets diverging apart to form a channel for placement of weld material.

9. An article of manufacture as in claim 7 in which the inner end portion is formed with a vertical height at least 50% greater than the vertical height of the outer end portion whereby a pair of the bodies when mounted on the end of a tip form an outwardly pointed wedge.

10. An article of manufacture as in claim 7 in which lower surfaces of the side and end portions are formed concave for interfitting with outwardly convex surface portions of a worn tip.

* * * * *